US011230902B1

(12) United States Patent
Byrd et al.

(10) Patent No.: US 11,230,902 B1
(45) Date of Patent: Jan. 25, 2022

(54) INTERACTIVE PACKER MODULE AND SYSTEM FOR ISOLATING AND EVALUATING ZONES IN A WELLBORE

(71) Applicant: CNPC USA Corporation, Houston, TX (US)

(72) Inventors: Jayson Byrd, Humble, TX (US); Jianpeng Yue, Sugar Land, TX (US); Peng Cheng, Sugar Land, TX (US); Zhicheng Zhang, Heilongjiang (CN); Laijun Luo, Heilongjiang (CN); Liquan Ding, Heilongjiang (CN)

(73) Assignee: CNPC USA Corporation, Houston, TX (US)

( * ) Notice: Subject to any disclaimer, the term of this patent is extended or adjusted under 35 U.S.C. 154(b) by 0 days.

(21) Appl. No.: 17/064,862

(22) Filed: Oct. 7, 2020

(51) Int. Cl.

| | |
|---|---|
| ***E21B 33/12*** | (2006.01) |
| ***E21B 47/06*** | (2012.01) |
| ***E21B 47/10*** | (2012.01) |
| ***E21B 33/129*** | (2006.01) |

(52) U.S. Cl.
CPC ..... *E21B 33/1208* (2013.01); *E21B 33/12* (2013.01); *E21B 33/1291* (2013.01); *E21B 47/06* (2013.01); *E21B 47/10* (2013.01)

(58) Field of Classification Search
CPC .. E21B 33/12; E21B 33/1208; E21B 33/1291; E21B 47/06; E21B 47/10
See application file for complete search history.

(56) References Cited

U.S. PATENT DOCUMENTS

| | | | | |
|---|---|---|---|---|
| 2,352,834 | A * | 7/1944 | Hassler | E21B 43/20 166/252.1 |
| 2,842,212 | A | 7/1958 | Lebourg | |
| 5,309,988 | A | 5/1994 | Shy et al. | |
| 6,684,956 | B1 | 2/2004 | Berry | |
| 8,720,554 | B2 | 5/2014 | Clapp et al. | |
| 9,027,640 | B2 | 5/2015 | Buyers et al. | |
| 9,080,421 | B2 | 7/2015 | Holderman et al. | |
| 9,938,771 | B2 * | 4/2018 | Khabashesku | C08J 3/242 |
| 2004/0112597 | A1 * | 6/2004 | Hamid | E21B 33/1285 166/250.17 |
| 2008/0223571 | A1 * | 9/2008 | Murray | E21B 33/1208 166/118 |
| 2012/0261137 | A1 | 10/2012 | Martinez et al. | |

(Continued)

*Primary Examiner* — Yong-Suk (Philip) Ro
(74) *Attorney, Agent, or Firm* — Craft Chu PLLC; Andrew W. Chu

(57) ABSTRACT

A packer module with selective control and fluid bypass can be interactive with other packer modules in a system for isolating and evaluating. The packer module includes a motor section, a conversion section, a control section, a sealing member, and an isolated flow path section. The control section includes a ramp sleeve cooperative with the sealing member to set a retracted configuration, an initial sealed configuration, and an isolated sealed configuration of the sealing member. The isolated flow path section includes an isolated flow path channel. The isolated flow path channel can only be opened with the sealing member in the isolated sealed configuration so that a zone formed by the packer module can be isolated and evaluated. Measuring and detecting instruments along the different flow paths through packer module evaluate the fluid properties of the bypass fluids and isolated fluids through the different flow paths.

20 Claims, 6 Drawing Sheets

(56) References Cited

U.S. PATENT DOCUMENTS

| | | | | |
|---|---|---|---|---|
| 2017/0284168 | A1* | 10/2017 | Zevenbergen | E21B 23/06 |
| 2018/0202269 | A1* | 7/2018 | Wensrich | E21B 43/26 |
| 2019/0048680 | A1* | 2/2019 | Stein | E21B 33/1208 |
| 2019/0153818 | A1 | 5/2019 | Campbell | |

* cited by examiner

INTERACTIVE PACKER MODULE AND SYSTEM FOR ISOLATING AND EVALUATING ZONES IN A WELLBORE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to zones in a wellbore. More particularly, the present invention relates a packer module that isolates and evaluates zones. Even more particularly, the present invention relates to a packer module having a controlled isolation flow path within an interactive system of the packer modules to selectively isolate and evaluate zones along the entire wellbore.

2. Description of Related Art Including Information Disclosed Under 37 CFR 1.97 and 37 CFR 1.98

Hydrocarbons are located at particular depths within a rock formation. A wellbore is drilled through the rock formation to reach those depths. The wellbore passes through portions of the rock formation without any hydrocarbons to reach the portions with hydrocarbons. The rock formation can be organized into production zones, that is, portions of the rock formation with hydrocarbons, and non-productive zone, that is portions of the rock formation without hydrocarbons. There is not just a single targeted production zone to reach. The production zones cannot be identified with that level of precision yet. Drilling a wellbore is costly and complex so the wellbore must be drilled as efficiently as possible for as many hydrocarbons as possible, not just hydrocarbons from a single production zone. Thus, each wellbore passes through multiple production zones and multiple non-productive zones. There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tools with an isolation valve. In systems with multiple packers throughout the wellbore, different types of setting tools were required to be deployed each time to open and close packers in sequential order, See U.S. Pat. No. 2,842,212, issued on 1958 Jul. 8 to Lebourg and U.S. Pat. No. 5,309,988, issued on 1994 May 10 to Shy et al (Halliburton). These manual systems required the sequence and depth to be compatible.

The opening and closing of packer assemblies in the borehole is a known problem. The selective control can be electronic or automated as well as manual. It is known to have a controller to monitor downhole conditions (pressure, temperature, flow rate, etc.) and to trigger opening and closing according to downhole conditions. See U.S. Patent Publication No. 2012/0261137, published on 2012 Oct. 18 for Martinez et al.; U.S. Pat. No. 9,027,640, issued on 2015 May 12 to Buyers et al.; and U.S. Pat. No. 9,080,421, issued on 2015 Jul. 14 to Holderman et al.

The flow bypass for packer assemblies in the borehole is also a known problem, even when there was a setting tool. There had to be some flow bypass, while the setting tool was opening and closing, so some prior art setting tools incorporated a flow bypass on the setting tool. U.S. Pat. No. 6,684,956, issued on 2004 Feb. 3 to Berry; U.S. Pat. No. 8,720,554, issued on 2014 May 13 to Clapp et al, and U.S. Patent Publication No. 2019/0153818, published on 2019 May 23 for Campbell, show fluid bypass in multiple packer systems.

It is an object of the present invention to provide a packer module for isolating and evaluating zones in a wellbore.

It is another object of the present invention to provide a packer module with selective control for isolating a zone.

It is another object of the present invention to provide a packer module with fluid bypass.

It is another object of the present invention to provide a packer module with selective isolated fluid flow from the isolated zone.

It is an object of the present invention to provide a packer module having a control section with bypass flow channels and ramp sleeve for selective sealing for isolation of a zone and selective isolated flow from the zone.

It is an object of the present invention to provide a packer module to evaluate an isolated a zone.

It is another object of the present invention to provide a packer module with an isolated flow path section with a sensor channel.

It is an object of the present invention to provide an interactive system of packer modules for isolating and evaluating zones in a wellbore.

It is another object of the present invention to provide an interactive system of a packer module and an additional packer module to form an isolated zone between the packer modules.

It is an object of the present invention to provide a method for zone evaluation with a packer module.

It is another object of the present invention to provide a method for zone evaluation of a zone across a sealing member of a packer module.

It is an object of the present invention to provide a method for zone evaluation with a system of packer modules.

It is another object of the present invention to provide a method for zone evaluation of a zone isolated with a packer module and an additional packer module.

These and other objectives and advantages of the present invention will become apparent from a reading of the attached specification.

BRIEF SUMMARY OF THE INVENTION

Embodiments of the present invention include a packer module with selective control and fluid bypass. The packer module is interactive with other packer modules in communication with each other and a centralized control of a system. The packer module includes a motor section, a conversion section, a control section, a sealing member, and an isolated flow path section. The control section includes a ramp sleeve cooperative with the sealing member to set a retracted configuration, an initial sealed configuration, and an isolated sealed configuration of the sealing member. The isolated flow path section includes an isolated flow path channel. The isolated flow path channel can only be opened with the sealing member in the isolated sealed configuration so that a downstream zone formed by the packer module can be isolated and evaluated.

The motor section includes a motor housing, a plurality of motor section bypass flow channels, and a motor unit with a motor shaft so as to define a center axis.

The conversion section includes a conversion housing, and a conversion cam with conversion shaft. The conversion cam is comprised of a means to convert rotational movement around the center axis to longitudinal movement along the center axis. More specifically, there is a means to convert rotational movement of the motor shaft around the center axis to longitudinal movement of the control section along the center axis.

The control section includes a control housing, a plurality of control section bypass flow channels, a plurality of load slots, and the ramp sleeve. The ramp sleeve is on the control housing outer surface and includes a run in portion, a conical protrusion, a first seal portion, and a second seal portion. The first seal portion and the second seal portion have diameters thicker than the run in portion. The conical protrusion is the transition outward from the run in portion on the control housing outer surface to the first seal portion and the second seal portion.

The sealing member is in sliding engagement with the ramp sleeve of the control section. The sealing member is on the control section for running in the retracted configuration with the sealing member around the run in portion of the ramp sleeve. The sealing member has an initial sealed configuration with the sealing member around the first seal portion of the ramp sleeve so as to form sealing engagement to the wellbore, splitting the wellbore into an upstream zone and a downstream zone across the sealing member. The sealing member has an isolated sealed configuration with the sealing member around the second seal portion of the ramp sleeve. The ramp sleeve moved relative to the sealing member and isolated flow path section to open the isolated flow path channel.

The isolated flow path section includes an isolated flow path housing, a load carrying means, a plurality of isolated flow path section bypass flow channels, the isolated flow path channel, and a sensor channel. The isolated flow path channel has an isolated flow path inlet. The sensor channel extends longitudinally along the isolated flow path section and has an opening between the isolated path inlet end of the isolated flow path housing. The load carrying means mounted on the outer isolated flow path surface is in slide fit engagement with a corresponding load slot of the control section. The load carrying means can be comprised of sectional wedge lugs, pins or other anchoring components. The load carrying means can be textured for a stronger attachment to the conversion section. The load carrying means is compatible with all embodiments of the conversion cam of the conversion section, including the means to convert rotational movement to longitudinal movement.

Embodiments of packer module include flow paths through the configurations of the packer module. There is flow through the motor section bypass flow channels, the control section bypass flow channels, and the isolated flow path section bypass flow channels to pass bypass fluid through the packer module. There is flow through the isolated flow path inlet and isolate flow path channel to pass isolated fluid from the downstream zone through the packer module. Sensors and detectors along the different flow paths through packer module evaluate the fluid properties of the bypass fluids and isolated fluids through the different flow paths. All flow paths end outside of the packer module, so all fluids (bypass and isolated from the downstream zone) will recombine and flow to the next packer module.

The present invention also includes a system for isolating and evaluating, comprising a packer module and an additional packer module. There are conventional sensors and meters in the different flow paths to measure rheological properties and environmental conditions. The sensors and meters provide data that be used for control signals communicated to the packer modules. The system is modular so each packer module is the same and interchangeable with each other. In the simplest embodiment, the system includes more than one packer module: a packer module and an additional packer module. The additional packer module has the same isolation of the corresponding additional downstream zone. The additional isolated fluids and the bypass fluids mix back together after the additional packer module.

In the system embodiment, the packer module can set the sealing member to cap the additional downstream zone. The additional downstream zone of the additional packer module is now also the upstream zone of the packer module. This zone capped by the sealing member and the additional sealing member as an isolation middle zone. The system can now evaluate the isolated fluid from the additional downstream zone of the additional packer module and the resulting mixture of the isolated fluid and the fluid bypass at the packer module.

The system of the present invention has multiple checkpoints to confirm analysis and to monitor changes as different isolated fluids mix into the bypass fluid flow. The system can monitor the additions and changes contributed to the bypass fluid flow from each zone. The profile of the wellbore can be more precisely and consistently determined by the system with a packer module and at least one additional packer module. Embodiments of the system further include more packer modules to determine a complete profile of the zones and the contributions from all zones.

Embodiments of the present invention include the method of zone evaluation using a packer module and using a system of packer modules. The method includes running a packer module in a borehole with the sealing member in the retracted configuration, placing the packer module in a location in the borehole, and transitioning the sealing member in the retracted configuration to the sealing member in the initial sealed configuration so as to form the downstream zone and the upstream zone. In the system embodiment, an additional packer module is run in the borehole to a different location. The embodiments of the methods include measuring bypass fluids through the packer modules to determine fluid characteristics modified by each zone passed through.

The methods further include transitioning the sealing members in the initial sealed position to the sealing members in the isolated sealed configuration. The isolated fluid from the downstream zones now flow through the isolated flow inlet and the outlet end of the isolate flow path section. The isolated fluids from downstream zones through the isolated flow inlet can now be measured separate from the bypass fluids through the packer module. The contribution from each downstream zone is isolated for separate measurement so that the composition and profile through the wellbore can be determined with accuracy and precision. In the methods with the system, there is the isolated middle zone between the packer modules. The isolated fluids from the isolated middle zone are now bypass fluids at the packer module. Now, the isolated fluids from the additional downstream zone of the additional packer module can be confirmed by the packer module. The packer modules are in communication through a network with other packer modules and a centralized control to coordinate placement along the wellbore and determination of fluid properties of bypass fluids and isolated fluids from the downstream zones. The centralized control is in communication with sensors and meters within the different flow paths of each module. Data from the sensors and meters are used to determine control signals from the centralized control to each module.

The collected data now has additional meaning. This zone capped by the sealing member and the additional sealing member is the isolation middle zone. The method with the system can now measure the fluids to evaluate the isolated fluid from the additional downstream zone of the additional packer module and the resulting mixture of the isolated fluid and the fluid bypass at the packer module. The method of using the system confirms analysis and monitors changes as different isolated fluids mix into the bypass fluid flow. The system and method can monitor the additions and changes contributed to the bypass fluid flow from each zone. The profile of the wellbore can be more precisely and consistently determined by the system. A complete profile of the zones and the contributions from all zones can be identified for better management of production from the zones.

DETAILED DESCRIPTION OF THE INVENTION

Figure 1:
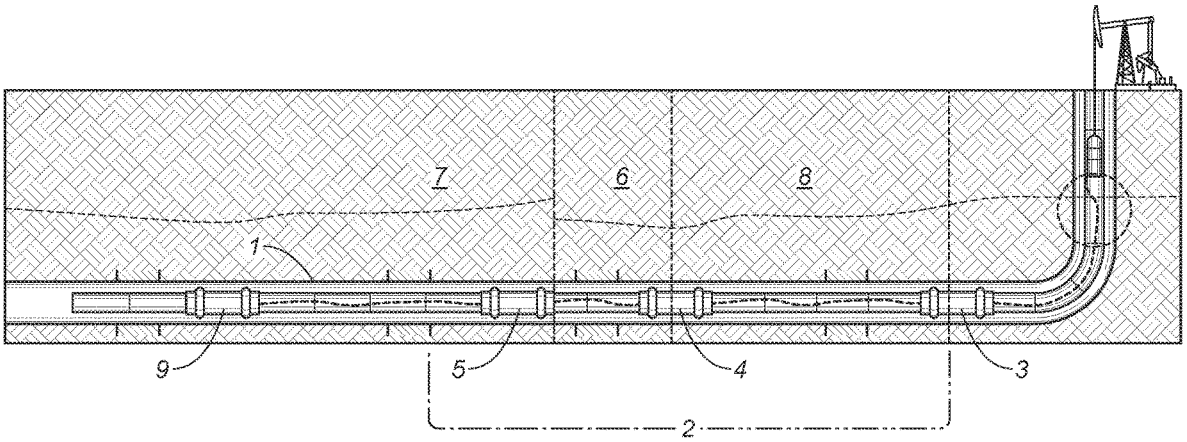
FIG. 1 is a schematic view of a system of packer modules, according to the present invention.

FIG. 1 shows that isolating and evaluating zones in a wellbore 1 can be achieved with a system 2 of packer modules 3, 4, 5, distributed through the wellbore 1, which crosses production zones 6 and non-productive zones 7 in the rock formation. The packer modules 3, 4, 5 have selective control to seal and unseal for isolating and removing isolation. There are fluid channels through the packer modules so that a packer module can be bypassed. Zones can be formed with a bypassed packer module within the zone. A zone is not required to be defined by only adjacent packer modules. The packer modules are interactive and communicate with each other to cooperatively form the zones to be isolated and evaluated. Known wireless and wired communication networks connect the packer modules for centralized control by a computer also connected with the network.

FIGS. 2-12 show embodiments of the packer module 10 of the present invention with selective control and fluid bypass. The packer module 10 can be interactive with other packer modules in communication with each other and a centralized control. The packer module 10 includes a motor section 20, a conversion section 40, a control section 60, a sealing member 94 and an isolated flow path section 100. The control section 60 includes a ramp sleeve 80 cooperative with the sealing member 94 to set a retracted configuration (FIG. 2), an initial sealed configuration (FIG. 3), and an isolated sealed configuration (FIGS. 4, 11 and 12) of the sealing member 94. The isolated flow path section 100 includes an isolated flow path channel 120. The isolated flow path channel 120 can only be opened with the sealing member 94 in the isolated sealed configuration so that a zone formed by the packer module 10 can be isolated and evaluated.

Figure 2:
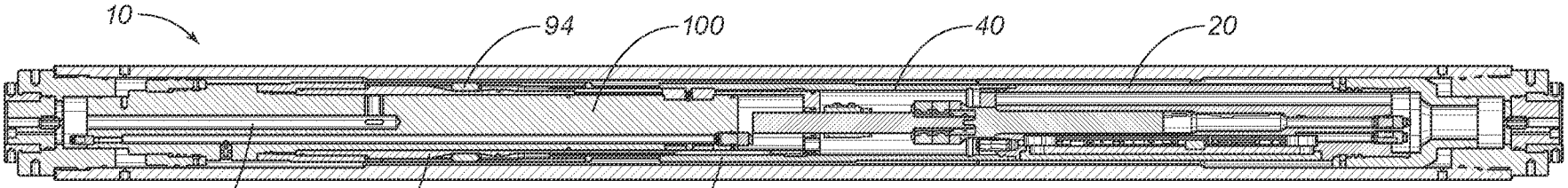
FIG. 2 is a schematic longitudinal sectional view of a packer module with the sealing member in the run in configuration, according to the present invention.
Figure 3:
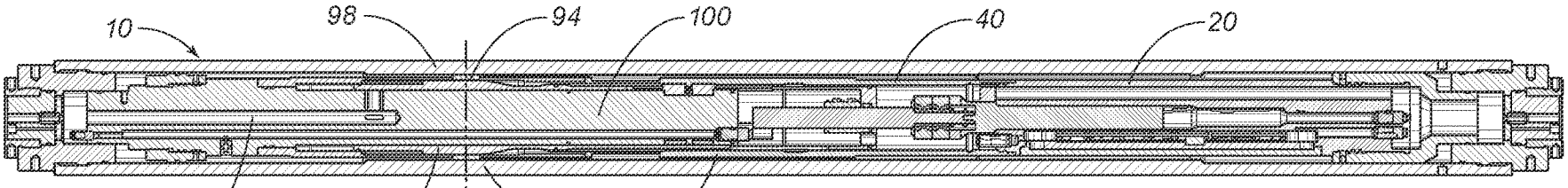
FIG. 3 is a schematic longitudinal sectional view of a packer module with the sealing member in the initial sealed configuration, according to the present invention.
Figure 4:
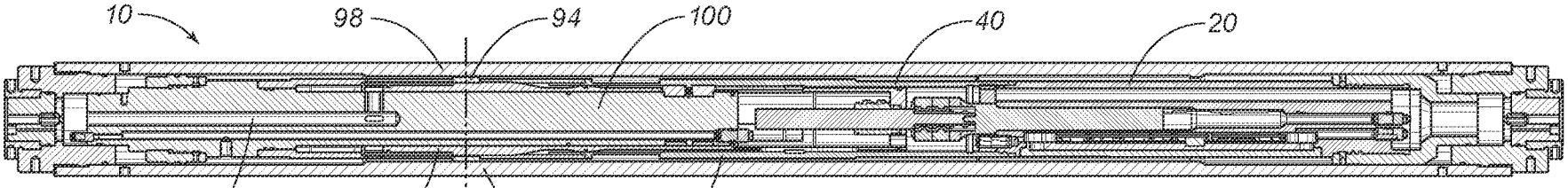
FIG. 4 is a schematic longitudinal sectional view of a packer module with the sealing member in the isolated sealed configuration, according to the present invention.
Figure 5:
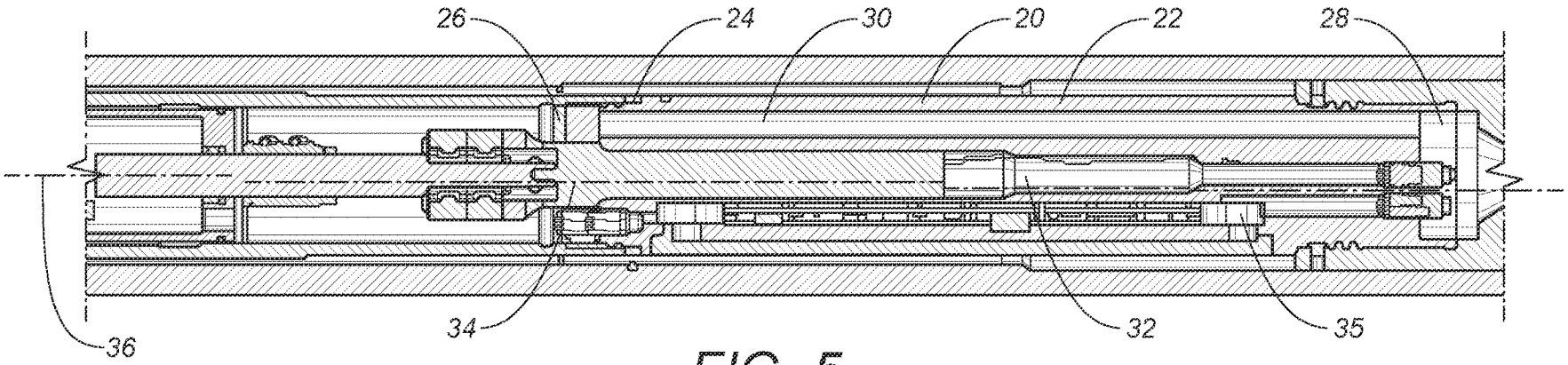
FIG. 5 is a schematic sectional view of an embodiment of the motor section of the packer module of the present invention.

The motor section 20 is shown in FIGS. 2-5. FIGS. 2-4 show the motor section 20 setting a retracted configuration (FIG. 2), an initial sealed configuration (FIG. 3), and an isolated sealed configuration (FIG. 4) of the sealing member 94. FIG. 5 shows enlarged sectional view of the motor section 20 comprising a motor housing 22 having an outer motor housing surface 24, a first motor section end 26, and a second motor section end 28 opposite the first motor section end 26. There is a plurality of motor section bypass flow channels 30 and a motor unit 32 within the motor housing 22. A motor shaft 34 extends out of the motor housing 22 from the motor unit 32 so as to define a center axis 36. The motor shaft 34 extends out of the first motor section end 26 and into the conversion section 40.

The motor unit 32 is on the center axis within the motor housing 22, and the motor section bypass flow channels 30 can be radially arranged around the center axis 36 or radially distributed around the motor unit 32 within the motor housing 22. In one embodiment, the motor unit 32 is on the center axis 36, and there are three other channels radially distributed around the motor unit 32: two motor section bypass flow channels 30 and a hardware channel 35. The three other channels can be equally distributed at 120 degrees from each other. Other radial distributions are also possible. The hardware channel 35 can house electronics for communication with a wireless network, hardware for sensors and wired connections to other components in the packer module 10. The motor unit 32 can include a rotary element and other conventional components for a motor to actuate or rotate the motor shaft 34.

The conversion section 40 is shown in FIGS. 2-4 and 6. FIGS. 2-4 show the conversion section 40 for generating longitudinal movement along the center axis 36 from rotational movement around the center axis 36. The rotational movement of the motor shaft 36 is converted to longitudinal movement of the control section 80 relative to the isolated flow path section 100. From FIG. 2 to FIG. 3, the conversion section 40 moves the control section 60 toward the motor section 20 and away from the isolated flow path section 100. The ramp sleeve 80 expands the sealing member 94 to seal against the wellbore. From FIG. 3 to FIG. 4, the conversion section 40 further moves the control section 60 toward the motor section 20 and away from the isolated flow path section 100 so that the isolated flow path channel 120 is opened for fluid connection through the packer module 10.

Figure 6:
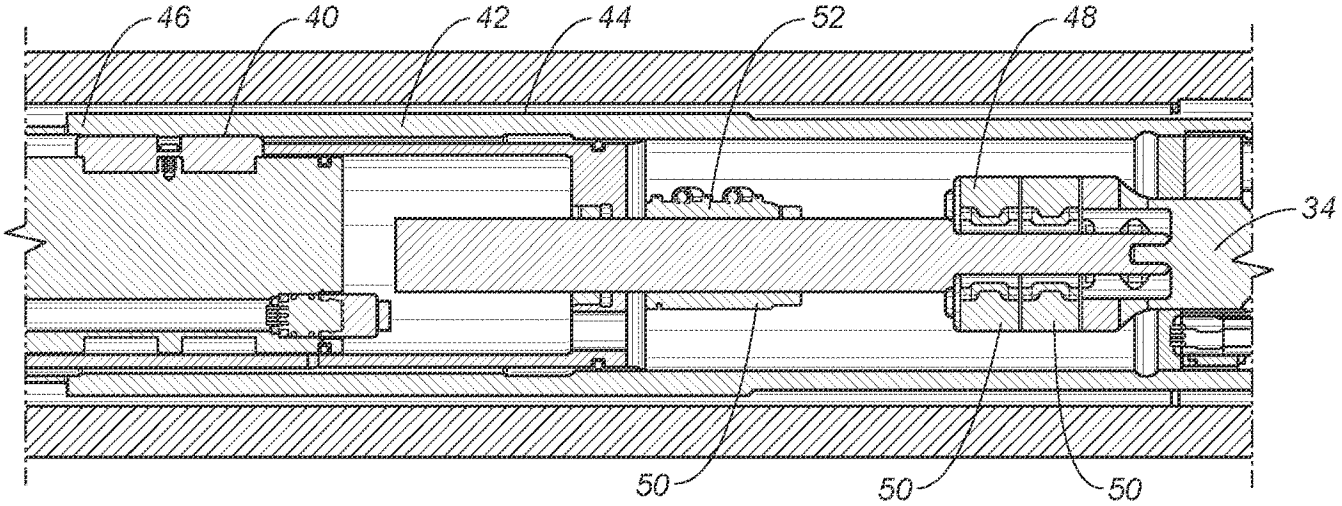
FIG. 6 is a schematic sectional view of an embodiment of the conversion section of the packer module of the present invention.

FIG. 6 shows an embodiment of the conversion section 40 being comprised of a conversion housing 42 having a motor end 44 and a seal end 46 opposite the motor end 44. The motor end 44 is engaged to the motor section 20 at the first motor section end 26. In FIG. 6, the conversion housing 42 can be fluid connection with the motor section bypass flow channels 30. The conversion section 40 also includes a conversion cam 48 with conversion shaft 49. The conversion cam 48 is connected to the motor shaft 34. In some embodiments, the conversion cam 48 is comprised of a means to convert 50 rotational movement around the center axis 36 to longitudinal movement along the center axis 36. In particular, there is a means to convert 52 rotational movement of the motor shaft 34 around the center axis to longitudinal movement of the control section 60 along the center axis 36. The means to convert 50, 52 can be types of worm gears, supports, or other conventional conversion devices. The means to convert 50, 52 can also be cooperative with each other to convert, control and support the movement of the conversion shaft 49, while attached to the control section 60 (See also FIG. 9).

The control section 60 is shown in FIGS. 2-4, 7, and 9-10. FIGS. 2-4 show the control section 60 for setting the retracted configuration (FIG. 2) with the sealing member 94 separate from the wellbore. The control section 60 slides relative to the sealing member 94 and isolated flow path section 100. In particular, the sealing member 94 slides along the ramp sleeve 80 to a larger diameter so as to form a seal against the wellbore in the initial sealed configuration of FIG. 3. Then, the sealing member 94 slides further on the ramp sleeve 80 at the same larger diameter to maintain the seal and to expose or open the isolated flow path channel 120 for fluid connection through the packer module 100 in the isolated sealed configuration (FIG. 4).

Figure 7:
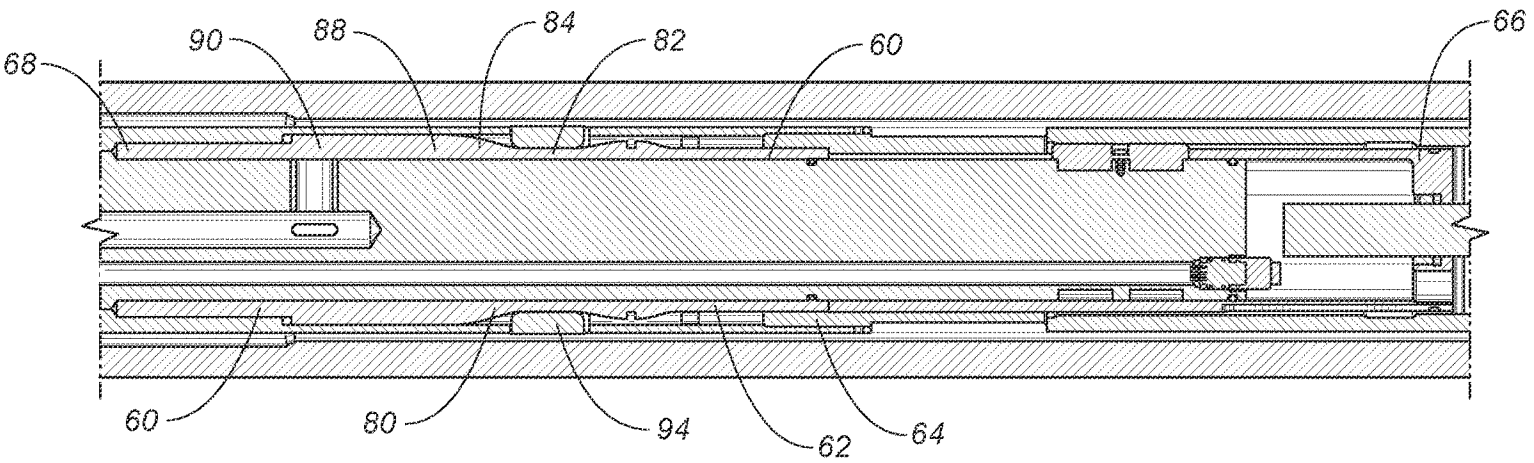
FIG. 7 is a schematic sectional view of an embodiment of the control section of the packer module of the present invention.
Figure 8:
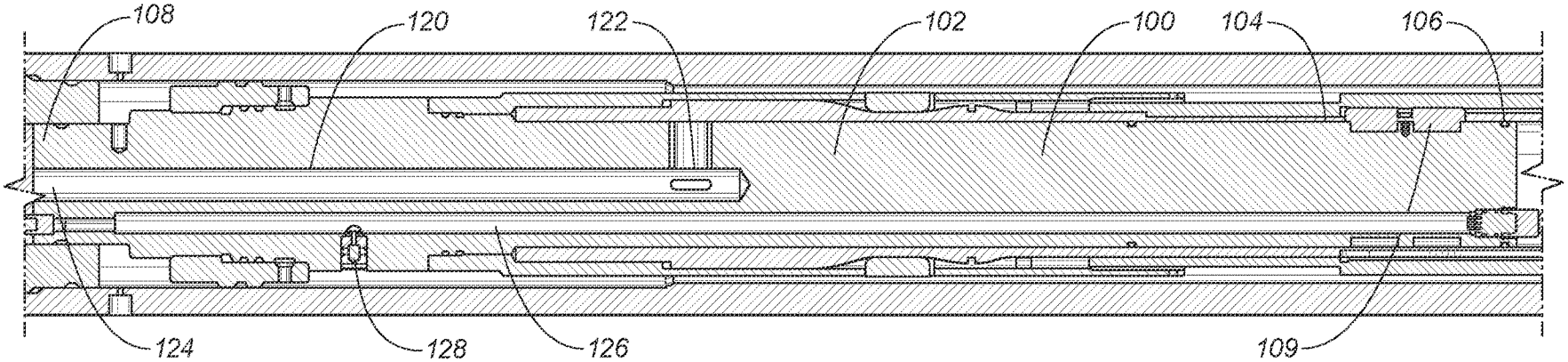
FIG. 8 is a schematic sectional view of an embodiment of the isolated flow path section of the packer module of the present invention.
Figure 9:
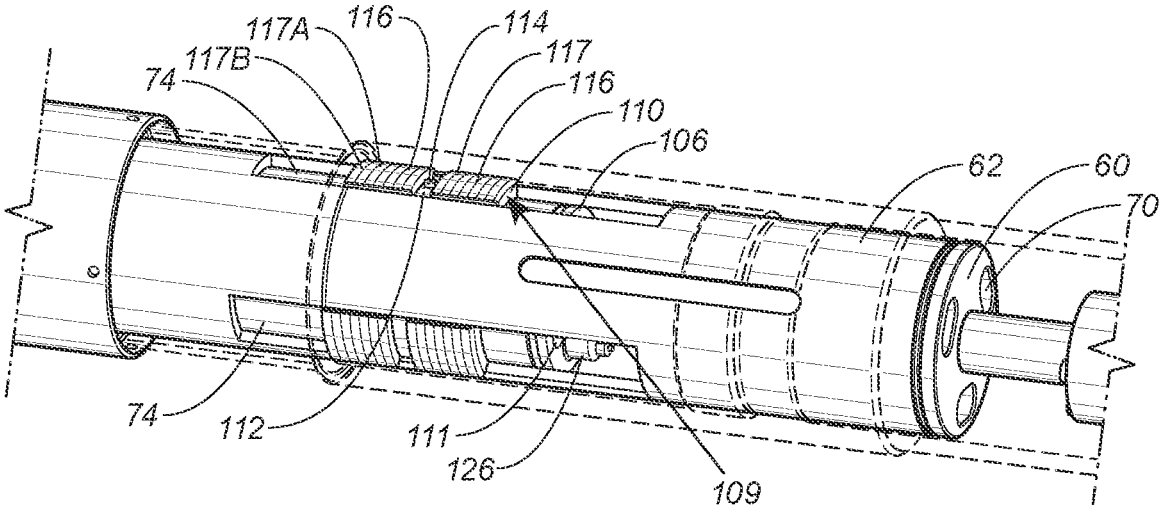
FIG. 9 is a schematic partial perspective view of an embodiment of the control section of the packer module of the present invention from FIG. 7.

FIG. 7 shows an embodiment of the control section 60 comprising the ramp sleeve 80 and a control housing 62 having a control housing outer surface 64, an inlet end 66 and an outlet end 68 opposite the inlet end 66. The inlet end 66 is oriented towards the motor housing 22. FIG. 9 shows the control section 60 having a plurality of control section bypass flow channels 70 within the control housing 62 and a plurality of load slots 74 within the control housing outer surface 64 and along the center axis 36. The control section bypass flow channels 70 can be in fluid connection with the motor section bypass flow channels 30 through the conversion housing 42. FIG. 9 shows embodiments of the control section bypass flow channels 70 as offset from the load slots 74. The load slots 74 are also radially arranged around the center axis 36.

An embodiment of the ramp sleeve 80 is shown in FIG. 7. The ramp sleeve 80 is on the control housing outer surface 64. The ramp sleeve 80 is comprised of a run in portion 82 between the outlet end 68 and the plurality of load slots 74. The ramp sleeve 80 also includes a conical protrusion 84 slanting outward from the control housing outer surface 64 so as to increase thickness of the control housing 62 corresponding to the run in portion 82 to a thickened diameter 86. There is a first seal portion 88 having the thickened diameter and a second seal portion 90 having the thickened diameter. The first seal portion 88 is between the conical protrusion 84 and the second seal portion 90.

FIGS. 2-4 show the sealing member 94 in sliding engagement with the ramp sleeve 80 of the control section 60. The sealing member 94 is on the control section 60 for running in the wellbore in FIG. 2 and in FIG. 7. The sealing member 94 has a retracted configuration with the sealing member 94 around the run in portion 82 of the ramp sleeve 80. The sealing member 94 extends outward from the center axis 36 so as to form a sealing engagement with the wellbore in FIGS. 3-4. The sealing member 94 has an initial sealed configuration of FIG. 3 with the sealing member 94 around the first seal portion 88 of the ramp sleeve 80 so as to form an upstream zone 96 and a downstream zone 98 across the sealing member 94. The motor section 20 is in the upstream zone 96. The sealing member 94 has an isolated sealed configuration of FIG. 4 with the sealing member 94 around the second seal portion 90 of the ramp sleeve 80. The ramp sleeve 80 moved relative to the sealing member 94 and isolated flow path section 100.

The isolated flow path section 100 is shown in FIGS. 2-4 and 8-12. FIGS. 2-4 show the isolated flow path section 100 for maintaining the isolated flow path channel 120 closed in the retracted configuration (FIG. 2) and initial sealed configuration (FIG. 3) and opening the isolated flow path channel 120 in the isolated sealed configuration (FIG. 4). The control section 60 moves by the conversion shaft 49, the relationships between the sealing member 94 and isolated flow path section 100 change.

FIGS. 8-12 show embodiments of the isolated flow path section 100 having an isolated flow path housing 102 in sliding engagement with the control section 60 and having an outer isolated flow path surface 104, a load end 106 facing the motor section 20, and a flow path end 108 opposite the load end 106. The isolated flow path section 100 also includes a load carrying means 109, the isolated flow path channel 120, and a sensor channel 126. The isolated flow path section 100 also includes a plurality of isolated flow path section bypass flow channels 111 within the isolated flow path housing 102 in FIGS. 11-12. The isolated flow path channel 120 has an isolated flow path inlet 122 between the load end 106 and the flow path end 108, and a flow path outlet 124 at the flow path end 108. The sensor channel 126 extends longitudinally along the isolated flow path section 100 and has an opening 128 between the isolated path inlet 122 and the flow path end 108.

Embodiments of the isolated flow path channel 120 are shown in FIGS. 2-4 as being oriented along the center axis 36. The isolated flow path channel 120 can be centered in the isolated flow path housing 102. FIGS. 2-4, FIGS. 9-10 and 12 show the sensor channel 126 within the isolated flow path housing 102 and radially arranged around the center axis 36. FIG. 11 show that the isolated flow path section bypass flow channels 111 can also be radially arranged around the center axis 36. Depending on the cross-section of a sectional view, the isolated flow path housing 102 may not show the isolated flow path section bypass flow channels 111 and the sensor channel 126 in all views (See FIGS. 4 and 12 for isolated flow path 120 and sensor channel 126 and FIG. 11 for the isolated flow path section bypass flow channels 111). The isolated flow path section bypass flow channels 111 are in fluid connection with the control section bypass flow channels 70 through the packer module 10. The isolated flow path channel 120 is sealed with the sealing member 94 in the retracted position, and FIG. 2 shows the control housing 62 covering the isolated flow path inlet 122. The isolated flow path channel 120 is still sealed with the sealing member 94 in the initial sealed position, and FIG. 3 shows the control housing still covering the isolated flow path inlet 122. The isolated flow path channel 120 is in fluid connection with the downstream zone 98 with the sealing member in the isolation sealed configuration of FIG. 4. The isolated flow path inlet 122 is between control housing 62 and flow path end 108 of the isolated flow path housing 102. In particular, the isolated flow path inlet 122 can be between the outlet end 68 of control housing 62 and the flow path end 108 of the isolated flow path housing 102.

Figure 10:
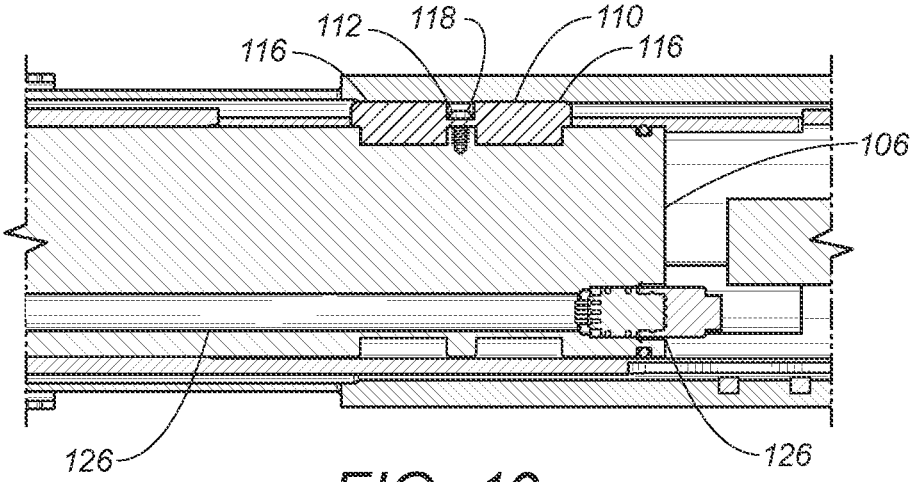
FIG. 10 is an enlarged partial schematic sectional view of an embodiment of the control section of the packer module of the present invention from FIG. 7.
Figure 11:
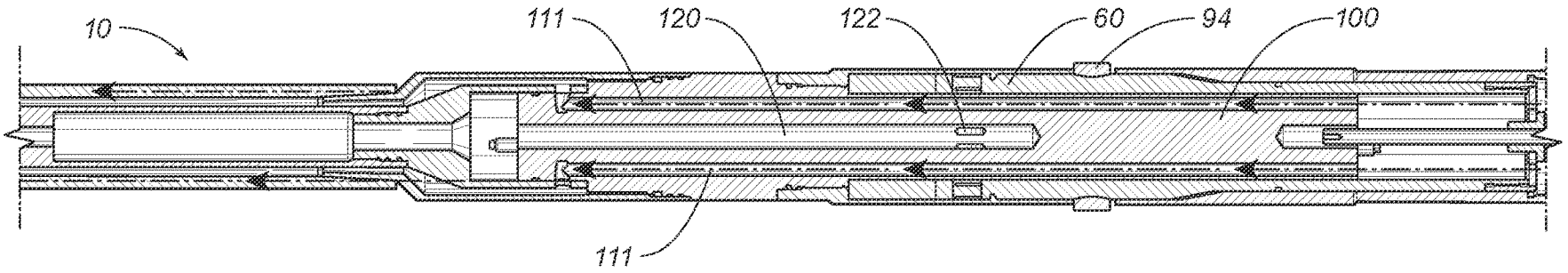
FIG. 11 is a schematic longitudinal sectional view of an alternate cross-section of the packer module with the sealing member in the isolated sealed configuration, according to FIG. 4, a flow path for bypass flow through the packer module.

Embodiments of the load carrying means 109 in FIGS. 9-10 show the load carrying means 109 mounted on the outer isolated flow path surface 104 and in slide fit engagement with a corresponding load slot 74 of the control section 60. FIGS. 9-10 show the load carrying means being comprised of sectional wedge lugs 110. Pins or other anchoring components are also load carrying means. In this embodiment, the wedge lugs 110 have the strength and durability to anchor to the isolated flow path housing 102 and to resist any rotational pressure from the conversion shaft 49 while remaining in slide fit engagement with a respective load slot 74 of the control section 60. Each lug 110 can have a textured outer lug surface 117. The textured outer lug surface 117 increases friction for a stronger locked position against the conversion section 40. The textured outer lug surface 117 hold position against the conversion section 40, while the respective load slot 74 of the control section 60 moves relative to the load carrying means 109. The textures outer lug surface 117 can be comprised of alternating rib protrusions 117A and rib slots 1176. Other surface components, such as grit coatings or pointed protrusions, can also be used to increase the friction against the conversion section 20 for a more stable hold position. Each lug 110 can be comprised of a center lug part 112 with attachment means 114 and wedge parts 116. The center lug part 112 can be placed between at least two wedge parts 116. Each wedge part 116 can also have a textured outer lug surface 117 for more stable connection of each wedge part 116 to the conversion section 40. The attachment means 114 can be a screw 118 or bolt or other conventional mechanical connectors.

In this embodiment, the wedge parts 116 are aligned longitudinally in a corresponding load slot 74 for the resilient and stable contact with the conversion section 40, while the control section 60 during transitions back and forth between the retracted configuration, initial sealed configuration, and isolated sealed configuration. The control section and load slots 74 move relative to the wedge parts 116 in a stable locked position. The sealing member 94 being in the retracted configuration (FIG. 2) corresponds to the control section 60 closest to the motor section 20 with the load carrying means 109 at one end of a respective load slot 74. The sealing member 94 in the isolated sealed configuration (FIG. 4) corresponds to the control section 60 furthest form the motor section 20 with the load carrying means 109 at an opposite end of the respective load slot 74. The sealing member 94 in the initial sealed configuration (FIG. 3) corresponds to control section 60 midway to the motor section with the load carrying means 109 being between the end and opposite end or in the middle of the respective load slot 74.

Embodiments of FIGS. 2-4 and 11-12 show the flow paths of the embodiments and configurations of the packer module 10 of the present invention. FIG. 2 shows the sealing member 94 in the retracted configuration for running in the wellbore during deployment of the packer module 10. There is flow through the packer module. The motor section bypass flow channels 30, the control section bypass flow channels 70 and the isolated flow path section bypass flow channels 111 are in fluid connection to pass fluid through the packer module 10. FIG. 3 shows the sealing member 94 in the initial sealed configuration also corresponding to motor section bypass flow channels 30, the control section bypass flow channels 70 and the isolated flow path section bypass flow channels 111 being in fluid connection to pass fluid through the packer module 10. Even with the sealing member 94 separating the downstream zone 98 from the upstream zone 96, the packer module 10 can selectively be a bypass as in FIG. 3. The packer module 10 has isolated the downstream zone 98 from the fluid flow through the wellbore.

Figure 12:
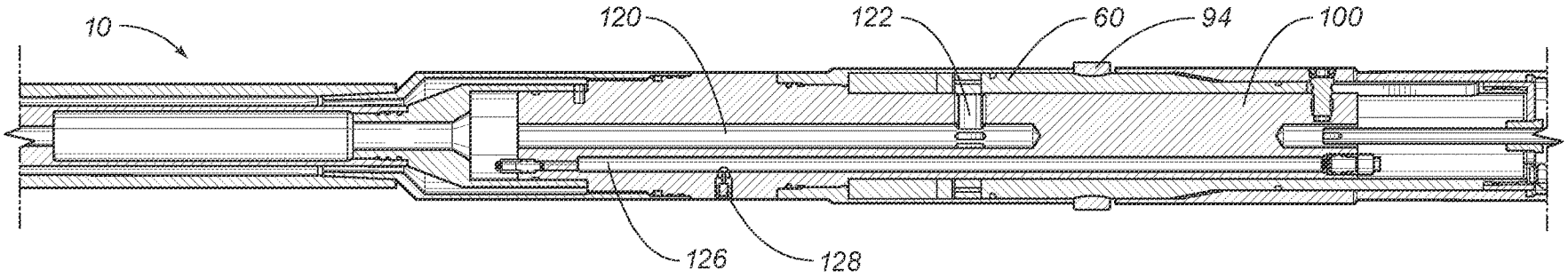
FIG. 12 is another schematic longitudinal sectional view of the embodiment of FIG. 4, showing the packer module with the sealing member in the isolated sealed configuration and the isolated flow path for isolated flow through the isolated flow path section.

FIGS. 4 and 12 show the sealing member 94 in the isolated sealed configuration corresponding to the downstream zone 98 in fluid connection with the isolated flow path channel 120. The isolated fluids from the downstream zone 98 are now flowing through the isolated flow path section 110 of the packer module 10. The sensor channel 126 and other instrumentation in the isolated flow path channel 120 can now evaluate the isolated fluids from the downstream zone 98 separate from the other bypass fluid through the packer module 10. All flow paths end outside of the packer module 10, so all fluids (bypass and isolated from the downstream zone) will recombine and flow to the next packer module.

In FIGS. 4 and 12, the sealing member 94 on the second seal portion 90 of the ramp sleeve 80 opens the isolated flow path channel 120 as the control housing 62 is moved longitudinally to uncover the isolated flow path inlet 122. Only longitudinal movement of the control section 60 is required.

FIG. 11 is an alternate cross-section of embodiment of the packer module 10 from FIGS. 4 and 12 for the sealing member 94 in the isolated sealed configuration. In FIG. 11, the isolated flow path section bypass flow channels 111 remain in fluid connection to pass fluid through the packer module 10. Both the isolated flow path section bypass flow channels 111 and isolated flow path channel 120 are open. The separate flows are not yet combined, so any sensors and meters to collect data from the isolated flow path 120 must be placed in the isolated flow path 120 before the combination of the flow through the isolated flow path section bypass flow channels 111. The isolated flow path housing 102 is fixedly engaged to the conversion section 40 as the control section 60 slides respective load slots 74 past the load carrying means 109. The different cross-sections of FIGS. 11-12 show how concurrent flow through each of the isolated flow path section bypass flow channels 111 and isolated flow path channel 120.

The present invention also includes a system 2 for isolating and evaluating, comprising a packer module 3, 4, 5 and an additional packer module 3, 4, 5. Each packer module 3, 4, 5 of FIG. 1 can be a packer module 10 of FIGS. 2-12. The system 2 is modular so each packer module 3, 4, 5 is the same and interchangeable with each other. In the alternate embodiment of the present invention as a system, there is a packer module and an additional packer module. The system 2 can also include sensors and meters in the different flow paths to measure rheological properties and environmental conditions. Temperature sensors, pressure gauges, water flow, and water cut meters are examples. These detecting and measuring instruments provide data that be used for control signals communicated to the packer modules 3, 4, 5. There can be a centralized control (not shown) in communication with detecting and measuring instruments within the different flow paths of each packer module 3, 4, 5. Data from these sensors, monitors, and meters are used to determine control signals from the centralized control to each packer module 3, 4, 5.

The packer module 10 includes a motor section 20, a conversion section 40, a control section 60, a sealing member 94 and an isolated flow path section 100. The control section 60 includes a ramp sleeve 80 cooperative with the sealing member 94 to set a retracted configuration (FIG. 2), an initial sealed configuration (FIG. 3), and an isolated sealed configuration (FIG. 4) of the sealing member 94. The isolated flow path section 100 includes an isolated flow path channel 120. The isolated flow path channel 120 can only be opened with the sealing member 94 in the isolated sealed configuration so that a downstream zone 98 formed by the packer module 10 can be isolated and evaluated.

Thus, an additional packer module 10 includes the corresponding components: an additional motor section 20, an additional conversion section 40, an additional control section 60, an additional sealing member 94 and an additional isolated flow path section 100. The additional control section 60 includes an additional ramp sleeve 80 cooperative with the additional sealing member 94 to set an additional retracted configuration (FIG. 2), an additional initial sealed configuration (FIG. 3), and an additional isolated sealed configuration (FIG. 4) of the additional sealing member 94. The additional isolated flow path channel 120 can only be opened with the additional sealing member 94 in the additional isolated sealed configuration so that an additional downstream zone 98 formed by additional the packer module 10 can be isolated and evaluated.

In the system 2 of the present invention the additional downstream zone of the additional packer module 3 and the upstream zone 96 of the packer module 4 form an isolation middle zone 8. The additional packer module 3 has the same isolation of the corresponding additional downstream zone 98. The additional isolated fluids and the bypass fluids mix back together after the additional packer module 3. In the system 2, the packer module 4 can set the sealing member 94 to cap the additional downstream zone 98. The additional downstream zone of the additional packer module 3 is now also the upstream zone 96 of the packer module 4. This zone capped by the sealing member 94 and the additional sealing member 94 is an isolation middle zone 8.

The system 2 can now evaluate the isolated fluid from the additional downstream zone of the additional packer module 3 AND the resulting mixture of the isolated fluid and the fluid bypass at the packer module 4 AND the fluid bypass before the mixture. The system 2 has multiple checkpoints to confirm analysis and to monitor changes as different isolated fluids mix into the bypass fluid flow. The system 2 can monitor the additions and changes contributed to the bypass fluid flow from each zone. The detecting and measuring instruments in the different flow paths provide the data to the centralized control, which can be in wired connection or wireless connection with the respective instruments. The centralized control is also in communication with packer modules 3, 4, 5 in order to send control signals to the respective motor sections for opening and closing respective isolated flow path inlets of the corresponding packer modules 3, 4, 5. Data from the sensors and meters are used to determine control signals from the centralized control to each module and to characterize the fluids flowing from the different zones. The profile of the wellbore 1 can be more precisely and consistently determined by the system 2 with a packer module 4 and at least one additional packer module 3. Embodiments of the system 2 further include packer modules 5, 9 and others to determine a complete profile of the zones and the contributions from all zones.

The present invention also includes the method of zone evaluation with a packer module 10. The method includes running a packer module 10 in a borehole with the sealing member 94 in the retracted configuration, placing the packer module 10 in a location in the borehole, and transitioning the sealing member 94 in the retracted configuration to the sealing member 94 in the initial sealed configuration so as to form the downstream zone 98 and the upstream zone 96. There is selective control of the step of transitioning as the packer module 10 is controlled to activate the motor section 20. The control section 60 slides relative to the sealing member 94 to press the sealing member 94 to the wellbore for a sealing engagement to the wellbore. The packer module 10 is in communication through a network with other packer modules and a centralized control to coordinate placement along the wellbore.

In the method of the present invention, bypass fluids flow through the motor section bypass flow channels 30, the control section bypass flow channels 70 and the isolated flow path section bypass flow channels 11. The bypass fluids can flow past the sealing member 94 in the packer module 10 and be in fluid connection with the opening 128 of the sensor channel 126. Fluid properties of bypass fluids and isolated fluids from the downstream zone through the opening 128 of the sensor channel are measured. The retracted configuration and the initial sealed configuration of FIGS. 2 and 3 include measuring fluid properties of bypass fluids and isolated fluids from the downstream zone to evaluate the downstream zone.

Embodiments of the method of the present invention further include transitioning the sealing member 94 in the initial sealed position to the sealing member 94 in the isolated sealed configuration of FIG. 4. The isolated fluid from the downstream zone 98 now flows through the isolated flow inlet 122 and the outlet end 124 of the isolate flow path section 100. The isolated fluid from downstream zone 98 through the isolated flow inlet 122 can now be measured separate from the bypass fluids through the packer module 10. The contribution from the downstream zone 98 is isolated for separate measurement so that the composition and profile through the wellbore can be determined with accuracy and precision.

Additional embodiments of the method of the present invention include running a packer module 4 and an additional packer module 3 in a borehole with the sealing member in the retracted configuration and with the additional sealing member in the additional retracted position. The method of zone evaluation includes using a system 2 of at least two packer modules 3, 4. The additional packer module 3 is also placed in an additional location in the borehole, such as upstream from the packer module 4. The method includes transitioning the sealing member 94 in the retracted configuration to the sealing member 94 in the initial sealed configuration and transitioning the additional sealing member 94 in the additional retracted configuration to the additional sealing member 94 in the additional initial sealed configuration so as to form the additional downstream zone 98 and the additional upstream zone 96. In this embodiment, an isolated middle zone 8 is formed between the sealing member and the additional sealing member by the upstream zone of the packer module 4 and the additional downstream zone of the additional packer module 3.

There is still selective control of the step of transitioning as the packer modules are controlled to activate the respective motor sections. The control sections slide relative to the respective sealing members to press the respective sealing members to the wellbore for sealing engagements to the wellbore at the corresponding locations. The packer modules 3,4 are in communication through a network with other packer modules 3, 4, 5, 9 and a centralized control to coordinate placement along the wellbore. In combination with sensors and meters in the different flow paths to measure rheological properties and environmental conditions, the centralized control collects data for the profile of different flows and commands the packer modules to open and close isolated flow paths. The verification of a fluid profile can be tested and examined by opening and closing isolated flow paths, providing further robustness of the profiled flow through the system.

In this embodiment of the method of the present invention, bypass fluids flow through both sets of the motor section bypass flow channels, the control section bypass flow channels and the isolated flow path section bypass flow channels. The bypass fluids can flow past both sealing members in the packer module 4 and additional packer module 3 and be in fluid connection with the respective openings of the sensor channels. Fluid properties of bypass fluids and isolated fluids from the downstream zones are measured. The retracted configuration and the initial sealed configuration of FIGS. 2 and 3 include measuring fluid properties of bypass fluids and isolated fluids from the downstream zones to evaluate the downstream zones.

Furthermore, the method of using the system to evaluate and isolate can comprise the steps of transitioning the additional sealing member in the additional initial sealed position to the additional sealing member in the additional isolated sealed configuration. Additional isolated fluid flows through the additional isolated flow inlet and the additional outlet end. The additional isolated fluid is measured from the additional isolated flow inlet for the additional downstream zone, now the isolated middle zone 8.

The collected data from the same flow paths now has additional meaning. This zone capped by the sealing member 94 and the additional sealing member 94 is the isolation middle zone 8. The method with the system 2 can now measure the fluids to evaluate the isolated fluid from the additional downstream zone of the additional packer module 3 AND the resulting mixture of the isolated fluid and the fluid bypass at the packer module 4 AND the fluid bypass before mixture. The isolated flow path can be opened and closed to test the accuracy and precision of the data as well. The method of using the system confirms analysis and monitors changes as different isolated fluids mix into the bypass fluid flow.

The system 2 can monitor the additions and changes contributed to the bypass fluid flow from each zone. The profile of the wellbore 1 can be more precisely and consistently determined by the system 2 with a packer module 4 and at least one additional packer module 3. Embodiments of the system 2 further include packer modules 5, 9 and others to determine a complete profile of the zones and the contributions from all zones.

The present invention provides a packer module for isolating and evaluating zones in a wellbore. The packer module includes sealing member to form at least two zones relative to the packer module. The downstream zone can be isolated by the isolated flow path channel. The packer module evaluates bypass fluids through the packer module, isolated fluids from the downstream zone, and mixtures of the bypass fluids and the isolated fluids from the downstream zone. There is selective control of the packer module to change the flow paths through and around the packer module. The motor unit can actuate the sealing member back and forth between the retracted configuration, the initial sealed configuration, and the isolated sealed configuration.

Conventional sensors and measurement devices, like temperature thermometers, pressure gauges, viscosity, and flow speed monitors, along the different flow paths through the packer module gather measurements to profile the fluids passing through the different flow paths, including a fluid bypass flow path. The packer module includes a sensor channel with an opening in fluid communication with bypass fluids and isolated fluids from the downstream zone. One evaluation is the determination of fluid properties across the sealing member of the packer module. Another evaluation is the determination of fluid properties from an isolated zone between packer modules. The contributions and alterations of an isolated zone can be initially determined and tracked through the subsequent bypass flow through another packer module.

The packer module of the present invention is modular and may not always be used to isolate and define a zone. Thus, there is a fluid bypass flow path to allow the packer module to be placed in the middle of a zone, instead of defining a zone. Thus, the isolated fluid flow from a downstream zone formed by the packer module is selectively isolated. Embodiments of the present invention include a packer module having a control section with bypass flow channels and ramp sleeve for selective sealing for isolation of a zone and selective isolated flow from the zone.

The present invention also provides an interactive system of packer modules for isolating and evaluating zones in a wellbore. A system is more than one packer module. The packer modules are interactive and communicate with each other and a central control through wireless or wired connections or both. A packer module and an additional packer module can form an isolated zone between the packer modules for evaluation. The measurement and data from the zone capped by packer modules now disclose fluid properties of the isolated fluid from the additional downstream zone of the additional packer module and the resulting mixture of the isolated fluid and the fluid bypass at the other packer module. The method of using the system confirms analysis and monitors changes as different isolated fluids mix into the bypass fluid flow through the system.

The foregoing disclosure and description of the invention is illustrative and explanatory thereof. Various changes in the details of the illustrated structures, construction and method can be made without departing from the true spirit of the invention.

We claim:

1. A packer module comprising:

a motor section comprising:

a motor housing having an outer motor housing surface, a first motor section end, and a second motor section end opposite said first motor section end;

a plurality of motor section bypass flow channels within said motor housing;

a motor unit within said motor housing; and a motor shaft extending from said motor housing so as to define a center axis;

a conversion section comprising:

a conversion housing having a motor end and a seal end opposite said motor end, said motor end being engaged to said motor section; and a conversion cam with a conversion shaft, said conversion cam being connected to said motor shaft;

a control section comprising:

a control housing having a control housing outer surface, an inlet end and an outlet end opposite said inlet end, said inlet end being oriented towards said motor housing;

a plurality of control section bypass flow channels within said control housing;

a plurality of load slots within said control housing outer surface and along said center axis; and a ramp sleeve on said control housing outer surface, wherein said ramp sleeve is comprised of:

a run in portion between said outlet end and said plurality of load slots;

a conical protrusion slanting outward from said control housing outer surface so as to increase thickness of said control housing corresponding to said run in portion to a thickened diameter;

a first seal portion having said thickened diameter; and a second seal portion having said thickened diameter, said first seal portion being between said conical protrusion and said second seal portion;

a sealing member in sliding engagement with said ramp sleeve of said control section, wherein said sealing member has a retracted configuration with said sealing member around said run in portion of said ramp sleeve, wherein said sealing member has an initial sealed configuration with said sealing member around said first seal portion of said ramp sleeve so as to form an upstream zone and a downstream zone across said sealing member, said motor section being in said upstream zone, and wherein said sealing member has an isolated sealed configuration with said sealing member around said second seal portion of said ramp sleeve; and an isolated flow path section comprising:

an isolated flow path housing in sliding engagement with said control section and having an outer isolated flow path surface, a load end facing said motor section, and a flow path end opposite said load end;

load carrying means mounted on said outer isolated flow path surface and in slide fit engagement with a corresponding load slot of said control section;

a plurality of isolated flow path section bypass flow channels within said isolated flow path housing;

an isolated flow path channel having an isolated flow path inlet between said load end and said flow path end, and a flow path outlet at said flow path end; and a sensor channel extending longitudinally along said isolated flow path section and having an opening between said isolated path inlet and said flow path end, wherein said sealing member in said retracted configuration corresponds to said motor section bypass flow channels, said control section bypass flow channels, and said isolated flow path section bypass flow channels being in fluid connection, wherein said sealing member in said initial sealed configuration corresponds to said motor section bypass flow channels, said control section bypass flow channels, and said isolated flow path section bypass flow channels being in fluid connection, wherein said sealing member in said isolated sealed configuration corresponds to said downstream zone in fluid connection with said isolated flow path channel.

2. The packer module, according to claim 1, wherein said motor section bypass flow channels are radially arranged around said center axis.

3. The packer module, according to claim 1, wherein said conversion cam is comprised of a means to convert rotational movement around said center axis to longitudinal movement along said center axis.

4. The packer module, according to claim 1, wherein said conversion cam is comprised of a means to convert rotational movement of said motor shaft around said center axis to longitudinal movement of said control section along said center axis.

5. The packer module, according to claim 1, wherein said control section bypass flow channels are offset from said load slots.

6. The packer module, according to claim 1, wherein said load slots are radially arranged around said center axis.

7. The packer module, according to claim 1, wherein said sealing member extends outward from said center axis so as to form a sealing engagement with the wellbore.

8. The packer module, according to claim 1, wherein said load carrying means is comprised of a plurality of sectional wedge lugs.

9. The packer module, according to claim 8, where each lug is comprised of a center lug part with attachment means, and wedge parts, said center lug part being between at least two wedge parts.

10. The packer module, according to claim 9, wherein said wedge parts are aligned longitudinally in a corresponding load slot.

11. The packer module, according to claim 9, wherein each wedge part is comprised of a textured outer lug surface so as to hold position on said conversion section.

12. The packer module, according to claim 9, wherein each lug is comprised of a textured outer lug surface so as to hold position on said conversion section.

13. The packer module, according to claim 12, wherein said textured outer lug surface is comprised of alternating rib protrusions and rib slots.

14. The packer module, according to claim 1, wherein said sealing member in said retracted configuration corresponds to said load carrying means closest to said motor section within a respective load slot, and wherein said sealing member in said isolated sealed configuration corresponds to said load carrying means furthest from said motor section within said respective load slot.

15. The packer module, according to claim 1, wherein said isolated flow path channel is sealed with said sealing member in said retracted position, said control housing covering said isolated flow path inlet, wherein said isolated flow path channel is sealed with said sealing member in said initial sealed position, said control housing covering said isolated flow path inlet, and wherein said isolated flow path channel is in fluid connection with said downstream zone with said sealing member in said isolation sealed configuration.

16. A system for isolating and evaluating, comprising:

a packer module, according to claim 1; and an additional packer module in fluid connection with said packer module and being upstream from said packer module, wherein said additional packer module comprises:

an additional motor section comprising:

an additional motor housing having an additional outer motor housing surface, an additional first motor section end, and an additional second motor section end opposite said additional first motor section end;

a plurality of additional motor section bypass flow channels within said additional outer motor housing;

an additional motor unit within said additional motor housing; and an additional motor shaft extending from said additional motor housing so as to define an additional center axis;

an additional conversion section comprising:

an additional conversion housing having an additional motor end and an additional seal end opposite said additional motor end, said additional motor end being engaged to said additional motor section; and an additional conversion cam with additional conversion shaft connected to said additional motor shaft;

an additional control section comprising:

an additional control housing having an additional control housing outer surface, an additional inlet end and an additional outlet end opposite said additional inlet end, said additional inlet end being oriented towards said additional motor housing;

a plurality of additional control section bypass flow channels within said additional control housing;

a plurality of additional load slots within said additional control housing outer surface and along said additional center axis; and an additional ramp sleeve on said additional control housing outer surface, wherein said additional ramp sleeve is comprised of:

an additional run in portion between said additional outlet end and said plurality of additional load slots;

an additional conical protrusion slanting outward from said additional control housing outer surface so as to increase thickness of said additional control housing corresponding to said additional run in portion to an additional thickened diameter;

an additional first seal portion having said additional thickened diameter; and an additional second seal portion having said additional thickened diameter, said additional first seal portion being between said additional conical protrusion and said additional second seal portion;

an additional sealing member in sliding engagement with said additional ramp sleeve of said additional control section, wherein said additional sealing member has an additional retracted configuration with said additional sealing member around said additional run in portion of said additional ramp sleeve, wherein said additional sealing member has an additional initial sealed configuration with said additional sealing member around said additional first seal portion of said additional ramp sleeve so as to an additional upstream zone and an additional downstream zone across said additional upstream zone from said additional motor housing, and wherein said additional sealing member has an additional isolated sealed configuration with said additional sealing member around said additional second seal portion of said additional ramp sleeve; and an additional isolated flow path section comprising:

an additional isolated flow path housing in sliding engagement with said additional control section and having an additional outer isolated flow path surface, an additional load end facing said additional motor section, and an additional flow path end opposite said additional load end;

additional load carrying means mounted on said additional outer isolated flow path surface and in slide fit engagement with a corresponding additional load slot of said additional control section;

a plurality of additional isolated flow path section bypass flow channels within said additional isolated flow path housing;

an additional isolated flow path channel having an additional isolated flow path inlet between said additional load end and said additional flow path end, and an additional flow path outlet at said additional flow path end; and an additional sensor channel extending longitudinally along said additional isolated flow path section and having an additional opening between said additional isolated path inlet and said additional flow path end, wherein said additional sealing member in said additional retracted configuration corresponds to said additional motor section bypass flow channels, said additional control section bypass flow channels, and said additional isolated flow path section bypass flow channels being in fluid connection, wherein said additional sealing member in said additional initial sealed configuration corresponds to said additional motor section bypass flow channels, said additional control section bypass flow channels, and said additional isolated flow path section bypass flow channels being in fluid connection, wherein said additional sealing member in said additional isolated sealed configuration corresponds to said additional downstream zone in fluid connection with said additional isolated flow path channel, and wherein said additional downstream zone and said upstream zone form an isolation middle zone.

17. A method of zone evaluation, the method comprising the steps of:

running a packer module and an additional packer module, according to claim 16, in a borehole with said sealing member in said retracted configuration and with said additional sealing member in said additional retracted position, placing said packer module in a location in said borehole;

transitioning said sealing member in said retracted configuration to said sealing member in said initial sealed configuration so as to form said downstream zone and said upstream zone;

flowing bypass fluids through said motor section bypass flow channels, said additional control section bypass flow channels, and said additional isolated flow path section bypass flow channels in fluid connection; and measuring fluid properties of said bypass fluids and isolated fluids from said downstream zone through said opening of said sensor channel;

placing said additional packer module between said packer module and an entrance of said borehole;

transitioning said additional sealing member in said additional retracted position to said additional sealing member in said additional initial sealed configuration so as to form said additional upstream zone and said additional downstream zone, said upstream zone and said additional downstream zone forming an isolated zone between said sealing member and said additional sealing member;

flowing additional bypass fluids through said additional motor section bypass flow channels, said additional control section bypass flow channels, and said additional isolated flow path section bypass flow channels in fluid connection; and measuring fluid properties of said additional bypass fluids and additional isolated fluids from said additional downstream zone through said additional opening of said sensor channel, wherein said bypass fluids through said packer module are comprised of said additional bypass fluids through said additional packer module and said additional isolated fluids from said additional downstream zone of said additional packer module.

18. The method of zone evaluation, according to claim 17, further comprising the steps of:

transitioning said additional sealing member in said additional initial sealed position to said additional sealing member in said additional isolated sealed configuration;

flowing additional isolated fluid from said additional downstream zone through said additional isolated flow inlet and additional said outlet end; and measuring said additional isolated fluid in said additional isolated flow path channel.

19. A method of zone evaluation, the method comprising the steps of:

running a packer module, according to claim 1, in a borehole with said sealing member in said retracted configuration, placing said packer module in a location in said borehole;

transitioning said sealing member in said retracted configuration to said sealing member in said initial sealed configuration so as to form said downstream zone and said upstream zone;

flowing bypass fluids through said motor section bypass flow channels, said additional control section bypass flow channels, and said additional isolated flow path section bypass flow channels in fluid connection; and measuring fluid properties of said bypass fluids and isolated fluids from said downstream zone through said opening of said sensor channel.

20. The method of zone evaluation, according to claim 19, further comprising the steps of:

transitioning said sealing member in said initial sealed position to said sealing member in said isolated sealed configuration;

flowing isolated fluid from said downstream zone through said isolated flow inlet and said outlet end; and measuring said isolated fluid in said isolated flow path channel.

* * * * *